US009775451B1

(12) United States Patent
Chon et al.

(10) Patent No.: US 9,775,451 B1
(45) Date of Patent: Oct. 3, 2017

(54) MULTI-POSITION ADJUSTABLE PILLOW

(71) Applicant: Picasso Style LLC, Los Angeles, CA (US)

(72) Inventors: Jin Chon, Los Angeles, CA (US); Kevin Chon, Pasadena, CA (US)

( * ) Notice: Subject to any disclaimer, the term of this patent is extended or adjusted under 35 U.S.C. 154(b) by 0 days.

(21) Appl. No.: 15/409,474

(22) Filed: Jan. 18, 2017

(51) Int. Cl.
*A47C 20/00* (2006.01)
*A47G 9/10* (2006.01)

(52) U.S. Cl.
CPC ..... *A47G 9/10* (2013.01); *A47G 2009/1018* (2013.01)

(58) Field of Classification Search
CPC ..... A47C 20/021; A47C 20/00; A47C 20/02
USPC ..... 5/630, 640, 648, 652, 657
See application file for complete search history.

(56) References Cited

U.S. PATENT DOCUMENTS 4,864,669 A 9/1989 Jones
4,959,880 A 10/1990 Tesch
5,363,524 A 11/1994 Lang
5,809,594 A 9/1998 Isogai
5,953,777 A 9/1999 Buck
6,760,935 B1 7/2004 Burton et al.
8,656,537 B2 2/2014 Leifermann et al.
2001/0003219 A1 6/2001 Chou
2001/0027577 A1* 10/2001 Frydman ..... A47C 20/021 5/648
2003/0052035 A1 3/2003 Dickinson
2006/0031996 A1 2/2006 Rawls-Meehan
2012/0073056 A1 3/2012 Freund et al.
2013/0263377 A1* 10/2013 Wootten, Jr. ..... A47C 23/00 5/640
2014/0338130 A1 11/2014 Russell

* cited by examiner

*Primary Examiner* — Fredrick Conley
(74) *Attorney, Agent, or Firm* — Zeller IP Group, PLLC; Kyle M. Zeller

(57) ABSTRACT

An multi-position adjustable pillow intended to support a user's head, neck, shoulders, lower back, legs, and/or knees is provided. The pillow may include a cover sized to fit around a plurality of support pieces, including a top support piece and one or more removable bottom support pieces. The cover includes an aperture adapted to allow at least a bottom support piece to be inserted or removed. The aperture may be securable by a zipper or other fastening means. The support pieces may be made of a soft material, such as foam. The bottom support pieces may be made of a material that is of greater density and of lower firmness than the top support piece.

17 Claims, 5 Drawing Sheets

MULTI-POSITION ADJUSTABLE PILLOW

BACKGROUND

This specification relates generally to support devices. More particularly, the disclosure pertains to contoured pillows that are adjustable by a user.

Pillows are often used to support a part of a user's body during sleeping or resting. For example, pillows may be employed while sleeping on a bed or lying down on a couch to support a user's head, knees or legs. Pillows typically consist of a sealed fabric envelope having a soft stuffing or filling therein, such as down feathers or synthetic foam. The fabric envelope is typically covered with a pillowcase made of a cloth material.

Experts agree that the use of an appropriate pillow for sleeping is critical for good health. An incorrectly sized or shaped pillow may cause or exacerbate headaches, neck pain, arm numbness, breathing problems and/or sneezing.

Ideally, a pillow used to support the head and/or neck should help keep a user's head in a neutral alignment, where the user's head is positioned squarely on their shoulders without bending back too far or reaching too far forward. Pillows for supporting knees and/or legs should keep the spine in proper alignment, without putting unnecessary strain on the hip joint and lower back, while a user is lying on his or her back or side.

Unfortunately, conventional pillows are not adjustable. The fabric envelope is typically sealed such that a user may not access the filler material contained therein. Accordingly, a user of these pillows may need to purchase a new pillow if they change their sleeping position preference any time after a pillow purchase. Moreover, the filler material in conventional pillows may flatten, wear or weaken over time, resulting in a pillow that lacks proper support.

A number of adjustable pillows found in the prior art allow for pillow inserts or layers to be placed inside a pillowcase or shell. For example, U.S. Patent App. Pub. No. 2013/0263377; U.S. Pat. No. 5,953,777; and U.S. Pat. App. Pub. No. 2012/0073056 disclose customizable pillows having several inserts that can be placed inside a shell to adjust the thickness of the pillow. However, these references disclose conventional pillows for supporting the head while sleeping or resting. None of the references disclose a multi-position adjustable pillow having a convex-shaped insert to conform to a user's knees and/or neck. Moreover, these references do not teach the use of multiple inserts made from materials of differing shape, height, density and/or firmness.

There is therefore a need for a multi-position adjustable pillow that allows a user to add or remove one or more internal support pieces to increase or decrease the height of the pillow. It would be beneficial if such a pillow included multiple inserts made from materials of differing firmness and/or differing shape to allow for optimum conformation to a user's head, neck and/or legs.

SUMMARY

In accordance with the foregoing objectives and others, exemplary adjustable pillows are disclosed herein that can be employed to support any of a user's head, neck, knees and/or legs while the user is resting or sleeping on their back or side. The pillow may comprise one or more support pieces disposed within a cover, with at least one support piece being removable from the cover. By removing a support piece from within the cover, a dimension of the pillow, such as height, may be adjusted to the preference of the user. In one embodiment two support pieces may be used, with a removable, substantially flat bottom piece and a convex top piece (which may or may not be removable) contoured to support a user's upper body (e.g., head, neck and/or shoulders) and/or lower body (e.g., lower back, knees and/or legs). Alternative embodiments may include two or more bottom support pieces.

The cover may include an aperture, or opening, sized to allow the insertion of at least one removable support piece (e.g., at least one bottom support piece). The aperture may be opened and/or closed by a fastening mechanism, such as a zipper. The removable support piece(s) may be made of a soft material, such as foam. Each of the support pieces may be made from the same material or may be made from different materials. In one embodiment, the pillow may include a top support piece made of a first material and one or more bottom support pieces disposed under the top support piece, the bottom support piece(s) made of a second material that is firmer than the first material.

The pillow may be made in various sizes to conform to the body of an individual using the pillow. For example, the pillow may be sized for the upper body and/or lower body of an adult or a child.

In one embodiment, a multi-position adjustable pillow is provided. The pillow includes a cover having one or more panels (e.g., fabric or other material) joined to form an outer surface, an inner surface and an interior compartment sized to house a plurality of support pieces therein. The cover may further include a closable aperture extending from the outer surface to the inner surface of the cover, the aperture sized to receive one or more support pieces therein. The cover may also include a fastening mechanism in communication with the aperture, the fastening mechanism adapted to allow a user to open the aperture for insertion of one or more support pieces into the interior compartment and to securely close the aperture such that the one or more support pieces remain within the interior compartment during use.

The adjustable pillow may include a top support piece disposed within the interior compartment of the cover. The front support piece may have a convex top surface and substantially flat bottom, left side, and right side surfaces extending from the top surface to the bottom surface. The top support piece may be made from a first material having a first firmness.

The adjustable pillow may further include a removable bottom support piece disposed within the interior compartment of the cover, below the top support piece. The bottom support piece may have substantially flat, rectangular top, bottom, front, back, left, and right surfaces. The bottom support piece may be made from a second material, such as a material having a firmness that is greater than the firmness of the first material of the top support piece. And the bottom support piece may be shaped such that it may be inserted and/or removed by a user via the aperture in the cover.

The details of one or more embodiments of the subject matter of this specification are set forth in the accompanying drawings and the description below. Other features, aspects, and advantages of the subject matter will become apparent from the description, the drawings, and the claims.

DETAILED DESCRIPTION

Various multi-position adjustable pillows are disclosed herein that allow for the addition and/or removal of one or more support pieces such that the height of the pillow may be adjusted as desired or required by a user. The disclosed adjustable pillows comprise a number of support pieces and a cover surrounding the support pieces. A user may access the inside of the pillow, including the support pieces, through an aperture in the cover, which may be opened through the use of a fastening means such as a zipper. The user may then add or remove one or more support pieces, in order to adjust the height, firmness and/or feel of the pillow.

Figure 1A:
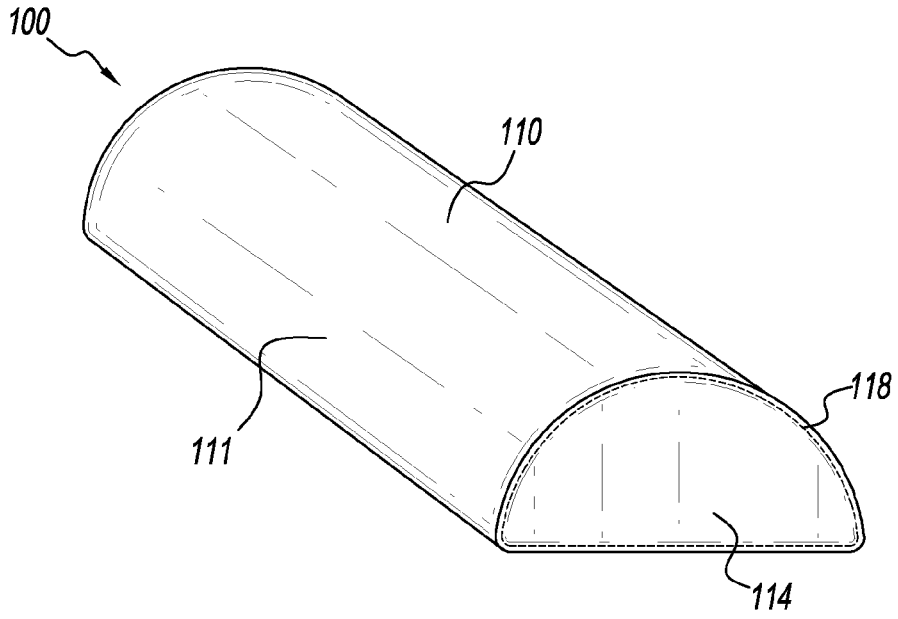
FIGS. 1A and 1B illustrate top and bottom perspective views of an exemplary multi-position adjustable pillow 100 comprising a cover 110 having a fastening mechanism 117 in a closed position.
Figure 1B:
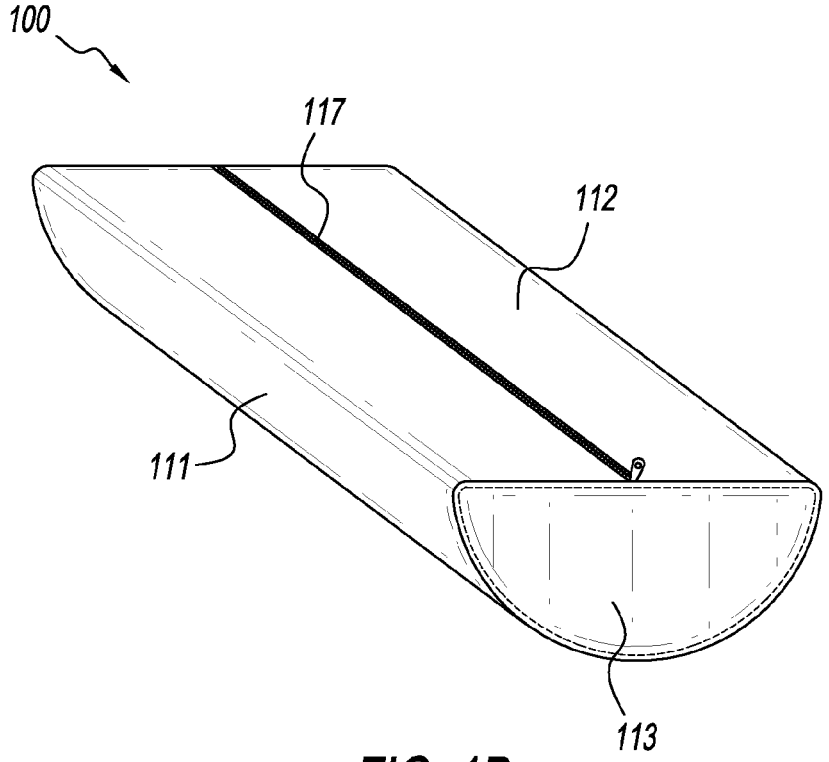

Referring to FIGS. 1A and 1B, top and bottom perspective views of an exemplary multi-position adjustable pillow 100 are illustrated, respectively. As shown, the adjustable pillow 100 comprises a semi-circular cylinder shape, with a convex top 111 side, a substantially flat, rectangular bottom 112 side, and substantially flat left 113 and right 114 sides that extend from the top side 111 to the bottom side 112. The pillow may comprise a length (defined as the distance between the left side 113 and right side 114 measured along its bottom 112) that is greater than its width (defined as the distance from a front side to a back side of the pillow measured along its bottom 112).

The adjustable pillow 100 is sized and shaped to provide support for, and/or proper alignment of, a user's neck, shoulders, head, legs, knees, hips, lower back, and/or spine when the user is resting or sleeping on his side or back. In addition, the specific curvature of the convex top side 111 may be adapted to conform to such body parts of a user. Because different users will have different physical characteristics, pillows may be made of varying sizes and shapes. For example, one embodiment of an adjustable pillow 100 may be sized to fit an adult female of average size, and another embodiment may be sized to fit a child. The dimensions listed below are only examples of dimensions that may be used.

In certain embodiments, the multi-position adjustable pillow may comprise a length of from about 15 inches to about 25 inches, and more particularly from about 18 inches to about 22 inches (e.g., about 20 inches). The pillow may comprise a width of from about 4 inches to about 12 inches, and more particularly from about 6 inches to about 10 inches (e.g., 8 inches). Accordingly, the pillow may comprise a length to width ratio of from about 1.25:1 to about 6:1 (e.g., about 2:1, about 3:1, about 4:1, or about 5:1). In one specific embodiment, the pillow comprise a length to width ratio of about 2.5:1.

The height of the pillow is defined as the distance between the top side 111 and the bottom side 112 thereof. Because the top side 111 of the pillow is typically convex, the height of the pillow varies along its width. For example, the pillow may comprise a maximum height along a lengthwise axis located equidistant between the front and back, outer edges of the pillow. Moreover, as discussed in detail below, the height of the pillow is adjustable via the insertion and/or removal of one or more bottom support pieces. Accordingly, the pillow may comprise a maximum height of from about 3 inches to about 6 inches (e.g., about 3 inches, about 3.5 inches, about 4 inches, about 4.5 inches, about 5 inches, about 5.5 inches or about 6 inches), depending on the number of support pieces disposed within the cover 110 and the height of such support pieces.

The adjustable pillow 100 comprises a cover 110 shaped to be placed about one or more support pieces. The cover may comprise an openable fastening mechanism 117 on a bottom side 112 thereof. The cover may comprise a single piece of material or may comprise a plurality of panels of material connected via stitching 118 or the like. Generally, the cover 110 defines an interior compartment adapted to hold a plurality of support pieces.

Figure 2:
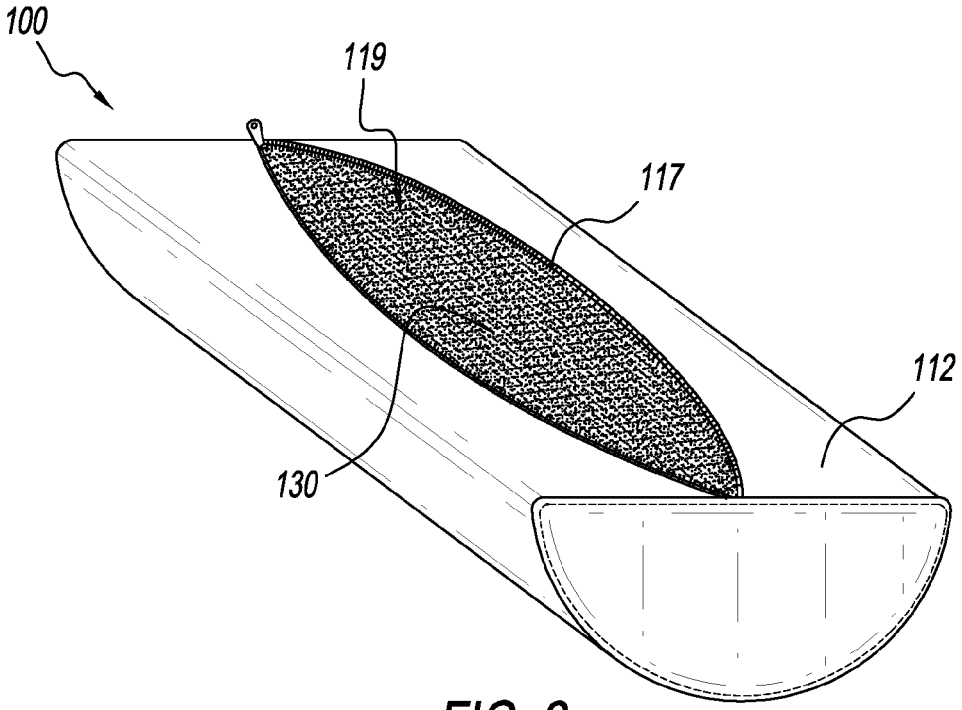
FIG. 2 illustrates the multi-position adjustable pillow 100, where the cover fastening mechanism 117 is in an open position to expose an aperture 119 and one or more support pieces 130.

Referring to FIG. 2, a fastening mechanism 117 located on the bottom side 112 of the cover 110 is illustrated in an open position. As depicted, one or more support pieces 130 are disposed within an interior compartment of the cover 110.

The cover comprises an aperture 119 extending from an outer surface of the cover 110 to an interior compartment thereof. The aperture 119 is sized such that one or more support pieces 130 may be inserted into and/or removed from an interior compartment of the cover 110 via the aperture 119.

The cover 110 comprises a fastening mechanism 117 adapted to allow the aperture 119 of the cover 110 to be opened such that one or more support pieces 130 may be inserted into the cover 110. The fastening mechanism 117 is further adapted to allow the aperture 119 to be closed in order to maintain the support pieces 130 securely within the interior compartment of the cover 110. In one embodiment, the fastening mechanism 117 is a zipper. In other embodiments, the fastening mechanism may be selected from the group consisting of: zippers, snaps, buttons, straps, hook and loop fasteners, and combinations thereof.

It will be appreciated that the aperture 119 and fastening mechanism 117 may be located anywhere along a surface of the cover 110. In one embodiment, the aperture is located along the length of a bottom side 112 of the cover. In other embodiments, the aperture may be located along an edge of a single side of the cover or may extend along a multiple sides thereof.

Alternatively, the cover 110 may not comprise a fastening mechanism. In such an embodiment, the cover may overlap itself at or near the aperture 119, providing a finished appearance to the cover.

The cover 110 may be adapted to protect the support pieces 130 from wear and tear, environmental elements (bacteria, moisture, dirt, pollen, pollutants and other allergens, etc.) and/or to provide a comfortable feel to a user (with or without an additional pillowcase surrounding the cover). To that end, the cover 110 may comprise one or more materials selected from the group consisting of: cotton, silk, satin, leather, microfiber, bamboo, rayon (e.g., viscose rayon derived from bamboo), polyester, polyurethane, and combinations thereof.

In one preferred embodiment, the cover 110 comprises a blend of polyester and viscose rayon derived from bamboo. Such material may comprise from about 20 percent to about 80 percent rayon (e.g., about 40 percent rayon) and from about 80 percent polyester to about 20 polyester (e.g., about 60 percent polyester). As a specific example, the cover may comprise a blended material of about 40 percent rayon (e.g., viscose rayon derived from bamboo) and about 60 percent polyester. Such a material may allow heat to distribute more evenly across the fabric and thus may contribute to even temperature regulation throughout the adjustable pillow. Moreover, such material is preferred as it is washable, hypoallergenic and dust mite resistant.

In certain embodiments, the cover 110 may comprise a thickness of from about 0.01 inches to about 1 inch. For example, the cover may comprise a thickness of about 0.01 inches, 0.03 inches, about 0.05 inches, about 0.1 inches, about 0.5 inches, about 0.75 inches or about 1.0 inches.

Although not shown, the cover 110 may comprise any number of decorative elements. For example, the cover 110 may include one or more flanges (fabric that extends from one or more side seams), piping (covered cord sewn into the seams as a decorate detail), and/or fringes or beading attached to one or more sides thereof.

Figure 3:
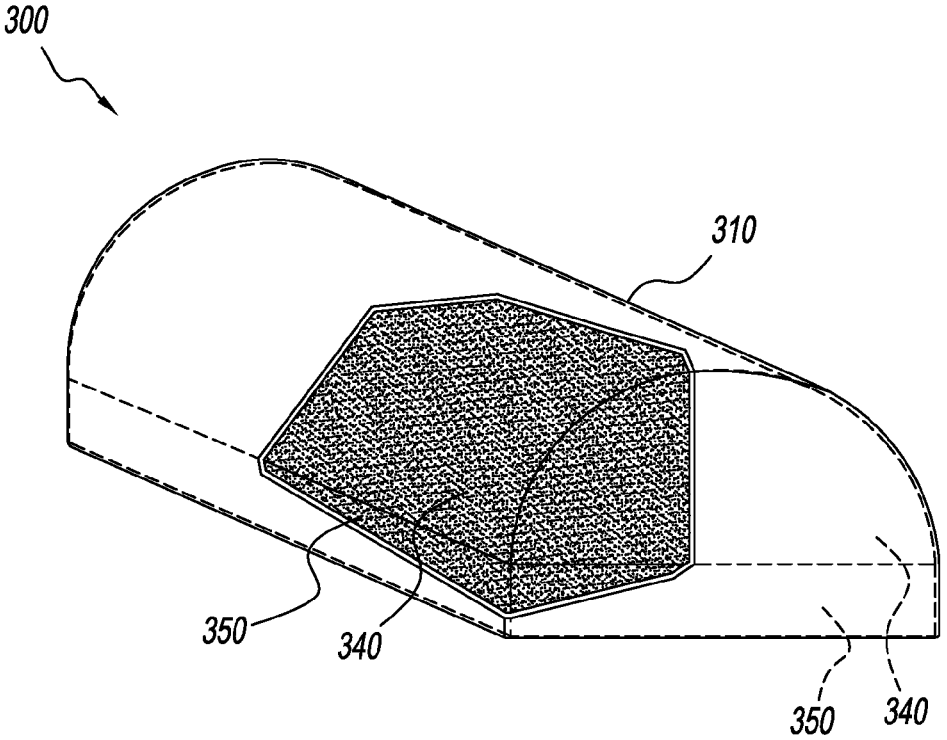
FIG. 3 illustrates a partial cutaway view of an exemplary multi-position adjustable pillow 300 comprising a top support piece 340 and a bottom support piece 350 disposed within a cover 310.

Referring to FIG. 3, a view of an exemplary multi-position adjustable pillow 300 is illustrated, where the cover 310 is partially cutaway to expose a top support piece 340 and a bottom support piece 350. Each of the top 340 and bottom 350 support pieces may comprise a soft material, such as but not limited to: memory foam, polyurethane foam, latex foam, closed cell foam, high density foam, supreem foam, evlon foam, high resilience foam, and/or combinations thereof. Each of the support pieces may comprise the same material or may comprise different materials.

Density is a property of a material defined by its mass divided by its volume. Resilience describes the ability and length of time required for a material to return to its original shape after it has been deformed. Firmness is measured as Indentation Load Deflection ("ILD"). To determine the ILD of a foam product, a sample measuring 15 inches by 15 inches by 4 inches is used and the force in pounds that it takes a 50 square-inch circular indenter to compress the material 1 inch (i.e., 25 percent of its thickness) is recorded. For example, if the sample requires 36 pounds of pressure to indent it 1 inch, its ILD is 36.

Different types of foam materials have a range of applicable densities and firmness. For example, typical polyurethane foam has a density of about 1.2 lbs. per cubic ft. and an ILD (firmness) of about 33. High density foam has a density of about 1.9 lbs. per cubic ft. and an ILD of from about 52 to about 58.

Memory foam, also referred to as viscoelastic polyurethane foam, is a polyurethane foam with additional chemicals added to increase density and lower firmness and resilience. Memory foam is softer than other foams, but is less supportive. Memory foam has a density of about 2 lbs. per cubic ft. to about 8 lbs. per cubic ft. and an ILD of from about 9 to about 16.

In certain embodiments, the top support piece 340 may comprise a first material and the bottom support piece(s) 350 may comprise a second material. The first material may have a lower firmness (i.e., be softer) than the second material to provide more comfort to the user. The second material may be a more supportive material, with a higher firmness than the first material. More specifically, the first material may have a density of from about 2.5 lbs. per cubic ft. to about 8 lbs. per cubic ft., while the second material may have a density of from about 1 lb. per cubic ft. to about 3 lbs. per cubic ft. The first material may have a firmness (i.e., ILD) of from about 9 to less than about 20, while the second material may have a firmness of from about 20 to about 150.

As an example, the first material of the top support piece 340 may comprise a foam having a density of between about 2.8 lbs. per cubic ft. and about 6 lbs. per cubic ft., and a firmness of between about 9 and about 15 (e.g., memory foam). The second material of the bottom support piece(s) 350 may comprise a foam having a density of between about 1.2 lbs. per cubic ft. and about 2 lbs. per cubic ft., and a firmness of between about 30 and about 40 (e.g., polyurethane foam).

The aperture (e.g., FIG. 2 at 119) and fastening mechanism (e.g., FIG. 2 at 117) may be placed to provide easy access to at least the bottom support piece(s) 350. In certain embodiments, the aperture may also be placed to provide access to the top support piece 340, but this is not required. Accordingly, the aperture may be of sufficient size to allow for the removal of the bottom support piece(s) and, optionally, the top support piece. In one embodiment, the top support piece 340 may be attached to the inner surface of the cover 310 and, therefore, may not be removable.

While FIG. 3 shows an exemplary adjustable pillow 300 with one bottom support piece 350, it will be appreciated that more than one bottom support piece may be employed. In such embodiments, the multiple bottom support pieces may be the same height, or may be of varying heights. For example, the pillow may comprise two bottom support pieces, each with a height of 0.5 inches. As an alternative example, the pillow may comprise two bottom support pieces, one with a height of 0.25 inches, the other with a height of 0.75 inches. Such embodiments may allow the user to make finer adjustments to the height of the pillow according to the user's needs.

In embodiments where multiple bottom support pieces 350 are used, each bottom support piece may comprise the same material. In other embodiments, each bottom support piece may comprise a different material, allowing the user finer control of the feel and support of the pillow. Each different material may have a different density and/or firmness, and the combination of inner support pieces of varying density and firmness will allow the adjustable pillow to accommodate a range of user needs. For example, if three bottom support pieces are used, and the innermost bottom support piece may have a greater firmness than the surrounding bottom support pieces, which in turn may have a greater firmness than the top support piece 340. In this way, a more gradual increase in firmness between the top and bottom support pieces may be accomplished.

Figure 4A:
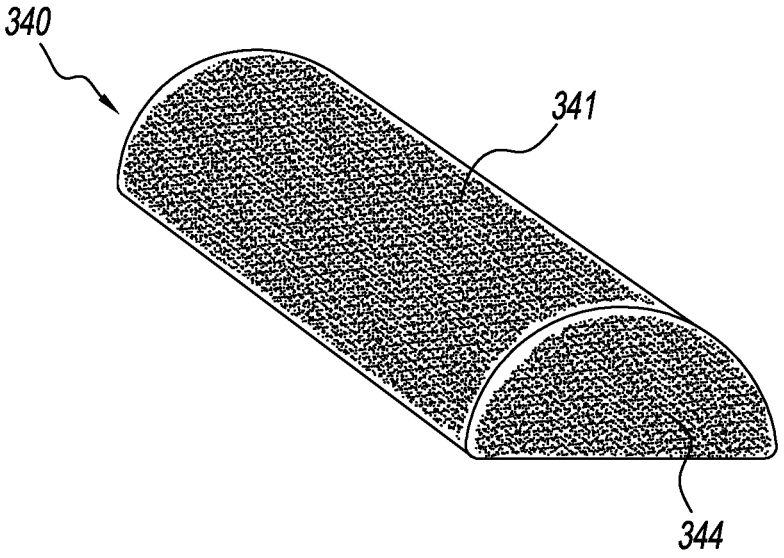
FIGS. 4A and 4B illustrate top and bottom perspective views of the top support piece 340.
Figure 4B:
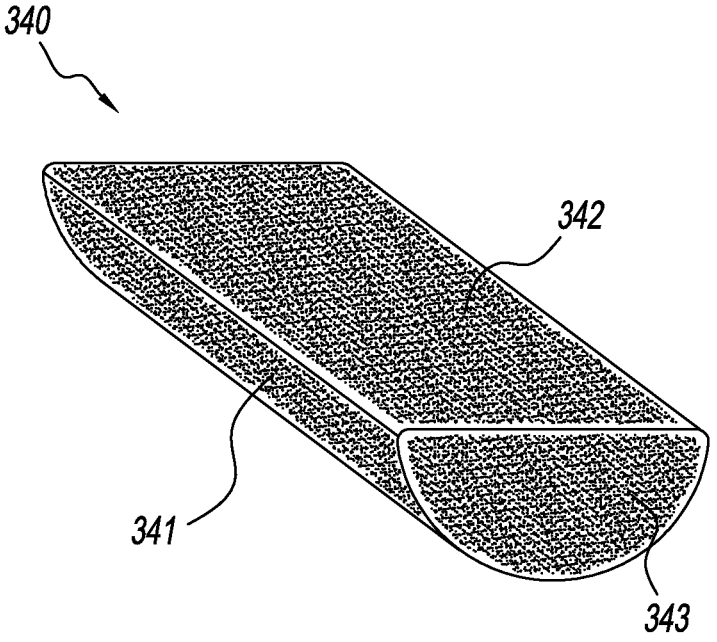

Referring to FIGS. 4A and 4B, top and bottom perspective views of the top support piece 340 are illustrated. The top support piece comprises a semi-circular cylindrical shape, with a top 341, a bottom 342, a left side 343, and a right side. The bottom 342 may comprise a substantially flat, rectangular shape. The left side 343, and right side 344 of the top support piece may comprise a substantially flat, semi-circular shape. The top 341 of the top support piece 340 may be convex.

In one embodiment, the length of the top support piece 340 (defined as the distance between the left side 343 and the right side 344 measured along the bottom 342) may be from about 15 inches to about 25 inches, and more particularly from about 18 inches to about 22 inches (e.g., about 20 inches).

The width of the top support piece 340 (defined as the distance from a front side to a back side of the support piece measured along its bottom 342) may be from about 4 inches to about 12 inches, and more particularly from about 6 inches to about 10 inches (e.g., 8 inches).

The height of the top support piece 340 is defined as the distance between the top side 341 and the bottom side 342 thereof. Because the top side 341 of the top support piece is typically convex, the height of the support piece varies along its width. For example, the top support piece may comprise a maximum height along a lengthwise axis located equidistant between the front and back, outer edges of the top support piece. In certain embodiments, the top support piece 340 may comprise a maximum height of from about 3 inches to about 5 inches (e.g., about 3 inches, about 3.5 inches, about 4 inches, about 4.5 inches, or about 5 inches).

Figure 5A:
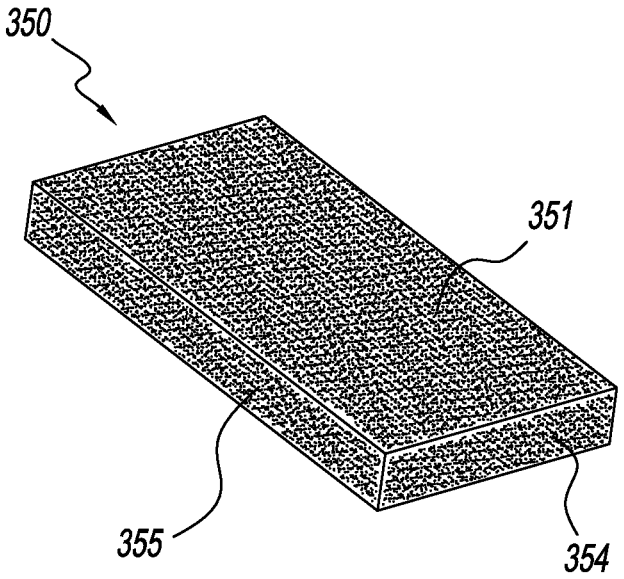
FIGS. 5A and 5B illustrate top and bottom perspective views of the bottom support piece 350.
Figure 5B:
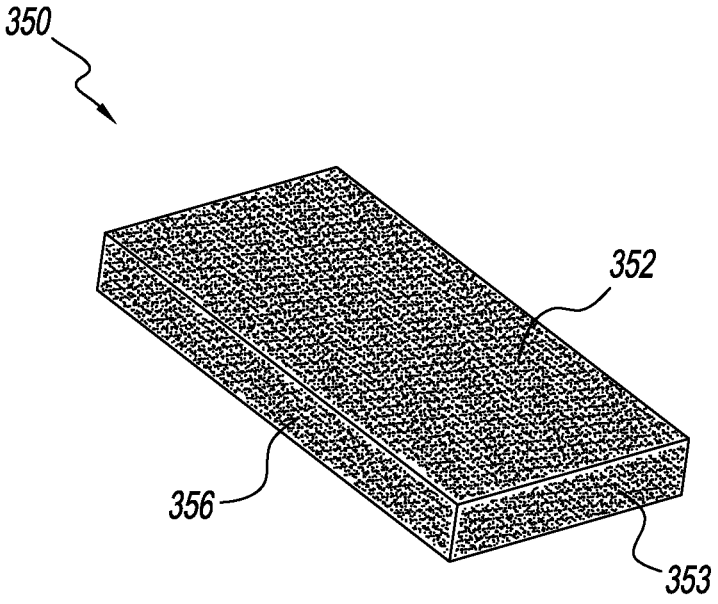

Referring to FIGS. 5A and 5B, top and bottom perspective views of an exemplary bottom support piece 350 are illustrated. As shown, the bottom support piece 350 comprises a substantially flat top 351, bottom 352, front 355, back 356, left side 353, and right side 354. The length (defined as the distance between the left side 353 and the right side 354) and width (defined as the distance between the front 355 and the back 356) of the bottom support piece 350 may be substantially similar to the length and width of the top support piece 340.

The height (defined as the distance between the top 351 and the bottom 352) of a given bottom support piece 350 may be from about 0.25 inches to about 2 inches (e.g., about 0.5 inches, about 0.75 inches, about 1 inch, about 1.25 inches, about 1.5 inches, about 1.75 inches, or about 2 inches). In embodiments where more than one bottom support piece 350 is used, the height of each bottom support piece may be from about 0.25 inches to about 1 inch.

Figure 6:
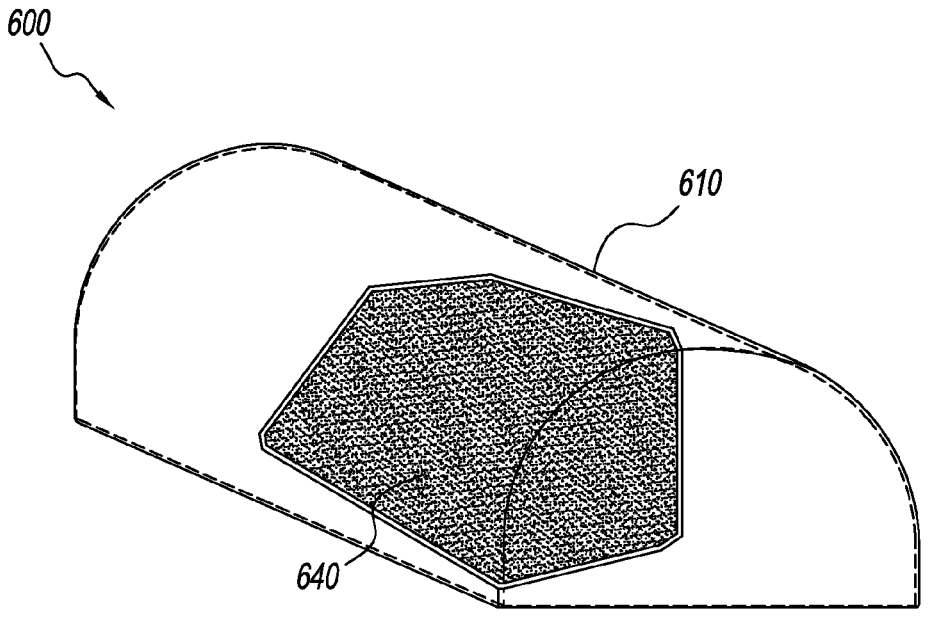
FIG. 6 illustrates a partial cutaway view of an alternative embodiment of a multi-position adjustable pillow 600 having a bottom support piece removed, where a top support piece 640 is disposed within a cover 610.

Referring to FIG. 6, a view of an alternative embodiment of the multi-position adjustable pillow 600 is illustrated, where a cover 610 is partially cutaway to expose a top support piece 640. A bottom support piece (see, e.g., FIG. 3 at 350) has been removed from the cover 610, e.g., via an aperture therein (see, e.g., FIG. 1B at 119).

The illustrated embodiment shows the adjustability of adjustable pillow 600. With the bottom support piece removed, the height of the pillow 600 is reduced, but the pillow still retains the ability to support the user's neck, head, shoulders, legs, knees, back, and/or spine in proper alignment. In addition, if the bottom support piece is made of a material with a different density and/or firmness than the top support piece, the removal of the bottom support piece may change the feel of the pillow, such as the overall density or firmness. In an embodiment where the adjustable pillow comprises more than one bottom support piece, one or more of the bottom support pieces may be removed to allow the user finer control over the height and/or feel of the pillow.

In an alternative embodiment, no cover, such as cover 610, may be used. In this embodiment, each of the support pieces may have its own cover. In this embodiment, the support pieces may be attached together using a temporary securing means, such as hook and loop fasteners and/or a temporary adhesive.

Various embodiments are described in this specification, with reference to the detailed discussed above, the accompanying drawings, and the claims. Numerous specific details are described to provide a thorough understanding of various embodiments. However, in certain instances, well-known or conventional details are not described in order to provide a concise discussion. The figures are not necessarily to scale, and some features may be exaggerated or minimized to show details of particular components. Therefore, specific structural and functional details disclosed herein are not to be interpreted as limiting, but merely as a basis for the claims and as a representative basis for teaching one skilled in the art to variously employ the embodiments. In this regard, directional terminology, such as "vertical," "horizontal," "top," "bottom," "front," "back," "left," "right," etc., is used with reference to the orientation of the drawing(s) being described. Because components of the embodiments can be positioned in a number of different orientations, the directional terminology is used for purposes of illustration and is in no way limiting.

The embodiments described and claimed herein and drawings are illustrative and are not to be construed as limiting the embodiments. The subject matter of this specification is not to be limited in scope by the specific examples, as these examples are intended as illustrations of several aspects of the embodiments. Any equivalent examples are intended to be within the scope of the specification. Indeed, various modifications of the disclosed embodiments in addition to those shown and described herein will become apparent to those skilled in the art, and such modifications are also intended to fall within the scope of the appended claims.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

All references including patents, patent applications and publications cited herein are incorporated herein by reference in their entirety and for all purposes to the same extent as if each individual publication or patent or patent application was specifically and individually indicated to be incorporated by reference in its entirety for all purposes.

What is claimed is:

1. An adjustable pillow comprising:

a cover comprising:

an outer surface, an inner surface and an interior compartment, the interior compartment sized to house a plurality of support pieces therein;

a closable aperture extending from the outer surface to the inner surface, the aperture sized to receive one or more support pieces therein; and a fastening mechanism in communication with the aperture, the fastening mechanism adapted to allow a user to:

open the aperture for insertion of one or more support pieces into the interior compartment; and securely close the aperture such that the one or more support pieces remain within the interior compartment during use;

a top support piece disposed within the interior compartment of the cover, the top support piece comprising:

a convex top surface;

a substantially flat, rectangular bottom surface; and substantially flat left and right surfaces extending from the top surface to the bottom surface, wherein the top support piece comprises a first material, wherein the top support piece comprises a length of from about 18 inches to about 22 inches, and wherein the top support piece comprises a width of from about 6 inches to about 10 inches; and a removable bottom support piece disposed within the interior compartment of the cover, below the top support piece, the bottom support piece comprising substantially flat top, bottom, front, back, left, and right surfaces, wherein the bottom support piece comprises a second material having a second firmness that is greater than a firmness of the first material of the top support piece, wherein the bottom support piece comprises a length that is substantially similar to the length of the top support piece, and wherein the bottom support piece comprises a width that is substantially similar to the width of the top support piece.

2. An adjustable pillow according to claim 1, wherein the cover is adapted to fit around the top support piece and bottom support piece, while substantially retaining the shape of the respective support pieces.

3. An adjustable pillow according to claim 1, wherein the fastening mechanism comprises one or more fasteners selected from the group consisting of: zippers, snaps, buttons, straps, and hook-and-loop fasteners.

4. An adjustable pillow according to claim 3, wherein the fastening mechanism is a zipper.

5. An adjustable pillow according to claim 1, wherein the cover comprises one or more materials selected from the group consisting of: cotton, silk, satin, leather, microfiber, bamboo, rayon, polyester, polyurethane, and combinations thereof.

6. An adjustable pillow according to claim 5, wherein the cover comprises about 40 percent rayon and about 60 percent polyester.

7. An adjustable pillow according to claim 1, wherein the first material of the top support piece comprises a foam having an Indentation Load Deflection (ILD) of less than 20.

8. An adjustable pillow according to claim 7, wherein the second material of the bottom support piece comprises a foam having an ILD of 20 or greater.

9. An adjustable pillow according to claim 8, wherein:

the first material of the top support piece is memory foam; and the second material of the bottom support piece is a high-density polyurethane foam.

10. An adjustable pillow according to claim 1, further comprising one or more additional bottom support pieces.

11. An adjustable pillow according to claim 1, wherein the top support piece comprises a length of about 20 inches.

12. An adjustable pillow according to claim 1, wherein the aperture is disposed in proximity to the bottom support piece and is sized to allow for removal of the bottom support piece.

13. An adjustable pillow according to claim 1, wherein the top support piece comprises a width of about 8 inches.

14. An adjustable pillow according to claim 1, wherein the bottom support piece comprises a maximum height of from about 0.25 inches to about 1 inch.

15. An adjustable pillow according to claim 14, wherein the top support piece comprises a maximum height of from about 3 inches to about 5 inches.

16. An adjustable pillow according to claim 1, wherein:

the top support piece comprises:

a length of about 20 inches;

a width of about 8 inches; and a maximum height of about 4 inches;

the bottom support piece comprises:

a length of about 20 inches;

a width of about 8 inches; and a height of about 1 inch;

the first material of the top support piece is memory foam; and the second material of the bottom support piece is a high-density polyurethane foam.

17. An adjustable pillow according to claim 16, wherein the cover comprises about 40 percent rayon and about 60 percent polyester.

* * * * *